US008538298B2

(12) United States Patent
Harada et al.

(10) Patent No.: US 8,538,298 B2
(45) Date of Patent: Sep. 17, 2013

(54) CHARGING MEMBER, PROCESS FOR ITS PRODUCTION, AND ELECTROPHOTOGRAPHIC APPARATUS

(75) Inventors: Masaaki Harada, Yokohama (JP); Toshiro Suzuki, Gotemba (JP); Hiroaki Watanabe, Odawara (JP); Taichi Sato, Numazu (JP); Keiji Nose, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/286,899

(22) Filed: Nov. 1, 2011

(65) Prior Publication Data

US 2012/0045250 A1 Feb. 23, 2012

Related U.S. Application Data

(63) Continuation of application No. PCT/JP2011/003862, filed on Jul. 6, 2011.

(30) Foreign Application Priority Data

Jul. 13, 2010 (JP) ..... 2010-158734

(51) Int. Cl.
*G03G 15/02* (2006.01)

(52) U.S. Cl.
USPC ..... 399/176

(58) Field of Classification Search
USPC ..... 399/176, 174, 115
See application file for complete search history.

(56) References Cited

U.S. PATENT DOCUMENTS

| | | | | |
|---|---|---|---|---|
| 4,420,548 | A | 12/1983 | Sakai et al. | |
| 5,458,937 | A * | 10/1995 | Nakamura et al. | 428/36.91 |
| 5,475,473 | A | 12/1995 | Masuda et al. | |
| 7,486,911 | B2 | 2/2009 | Harada | |
| 7,693,457 | B2 | 4/2010 | Kuruma et al. | |
| 7,835,669 | B2 | 11/2010 | Furukawa et al. | |
| 7,962,068 | B2 | 6/2011 | Kuroda et al. | |
| 8,064,803 | B2 | 11/2011 | Kuroda et al. | |
| 2007/0230997 | A1 * | 10/2007 | Matsui | 399/111 |
| 2007/0269234 | A1 * | 11/2007 | Kurita et al. | 399/111 |

(Continued)

FOREIGN PATENT DOCUMENTS

| | | | |
|---|---|---|---|
| JP | 7-152222 | A | 6/1995 |
| JP | 9-160355 | A | 6/1997 |

(Continued)

OTHER PUBLICATIONS

Nose, et al., U.S. Appl. No. 13/323,778, filed Dec. 12, 2011.

(Continued)

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

To provide a charging member that can not easily cause faulty cleaning. A charging member having a conductive support and an elastic layer that is a surface layer; the elastic layer having on its surface a region having been cured by irradiation with electron rays, where the region having been cured supports at least one type of spherical particles of spherical silica particles, spherical alumina particles and spherical zirconia particles in such a state that the spherical particles are exposed at least in part to the surface of the elastic layer so as to make the surface roughened.

8 Claims, 3 Drawing Sheets

(56) References Cited

U.S. PATENT DOCUMENTS

| | | | | |
|---|---|---|---|---|
| 2008/0075505 | A1* | 3/2008 | Nagamori et al. | 399/176 |
| 2008/0292366 | A1* | 11/2008 | Akama et al. | 399/286 |
| 2011/0176833 | A1 | 7/2011 | Harada et al. | |

FOREIGN PATENT DOCUMENTS

| | | | |
|---|---|---|---|
| JP | 2004-61640 | A | 2/2004 |
| JP | 2009-217094 | A | 9/2009 |
| JP | 2010-134452 | A | 6/2010 |

OTHER PUBLICATIONS

Sato, et al., U.S. Appl. No. 13/308,485, filed Nov. 30, 2011.

Watanabe, et al., U.S. Appl. No. 13/372,454, filed Feb. 13, 2012.

International Preliminary Report on Patentability in International Application No. PCT/JP2011/003862, Mailing Date Jan. 24, 2013.

* cited by examiner

CHARGING MEMBER, PROCESS FOR ITS PRODUCTION, AND ELECTROPHOTOGRAPHIC APPARATUS

CROSS-REFERENCE TO RELATED APPLICATIONS

This application is a continuation of International Application No. PCT/JP2011/003862, filed Jul. 6, 2011, which claims the benefit of Japanese Patent Application No. 2010-158734, filed Jul. 13, 2010.

BACKGROUND OF THE INVENTION

1. Field of the Invention

This invention relates to a charging member used in electrophotographic apparatus and the like, a process for its production, and an electrophotographic apparatus.

2. Description of the Related Art

It is common that a charging member used in the contact charging of a charging object member such as an electrophotographic photosensitive member is provided with an elastic layer containing a rubber, a thermoplastic elastomer or the like, in order to secure a uniform nip with the charging object member and prevent the charging object member from being scratched. However, a toner and its external additives tend to adhere to the surface of such an elastic layer. Also, where the elastic layer and the electrophotographic photosensitive member are kept in contact with each other at rest over a long period of time, the elastic layer may come to deform permanently (undergo permanent set) at its part kept in contact. For such a problem, as disclosed in Japanese Patent Application Laid-Open No. H09-160355, a charging member is proposed the surface of an elastic layer of which is irradiated with energy rays such as ultraviolet rays or electron rays to provide a surface modified layer.

SUMMARY OF THE INVENTION

Technical Problem

However, studies made on the charging member according to Japanese Patent Application Laid-Open No. H09-160355 have revealed that such a charging member may cause faulty cleaning on the electrophotographic photosensitive member. Such faulty cleaning coming about on the electrophotographic photosensitive member refers to a phenomenon that any residual toner on the surface of the electrophotographic photosensitive member, which fundamentally should have been removed with an elastic blade, slips through the elastic blade to lower the grade of electrophotographic images formed through subsequent cycles of electrophotographic image formation.

Accordingly, the present invention is directed to provide a charging member that can not easily cause faulty cleaning on the electrophotographic photosensitive member while having a flexibility high enough to form a nip between it and the electrophotographic photosensitive member in a sufficient width, and provide a process for its production. Further, the present invention is directed to provide an electrophotographic apparatus that can stably form high-grade electrophotographic images over a long period of time as it may less cause any lowering of charging performance with time.

Solution to Problem

According to one aspect of the present invention, there is provided a charging member comprising a conductive support and an elastic layer as a surface layer; wherein said elastic layer has a cured region on the surface thereof, said region having been cured by irradiation with electron rays, said cured region has spherical particles in such a state that the spherical particles are exposed at least in part so as to make the surface of said charging member roughened; and wherein said spherical particles are at least one type of spherical particles selected from the group consisting of spherical silica particles, spherical alumina particles and spherical zirconia particles.

According to another aspect of the present invention, there is provided a process for producing the above charging member; the process comprising the steps of:

(1) forming on the support a rubber layer containing the spherical particles;

(2) the step of sanding the surface of the rubber layer to make part of the spherical particles exposed to the surface; and (3) irradiating with electron rays the surface of the rubber layer to which surface the part of the spherical particles stand exposed, obtained by the step (2), to cure the surface to form the elastic layer.

According to one another aspect of the present invention, there is provided an electrophotographic apparatus which has the above charging member and a photosensitive member disposed in contact with the charging member.

Advantageous Effects of Invention

According to the present invention, it is able to obtain a charging member having been made to keep any faulty cleaning from coming about while having a flexible surface, and obtain a process for its production. According to the present invention, it is also able to obtain an electrophotographic apparatus that can stably form high-grade electrophotographic images over a long period of time.

Further features of the present invention will become apparent from the following description of exemplary embodiments with reference to the attached drawings.

DESCRIPTION OF THE EMBODIMENTS

The present inventors have made many studies on the reason why the charging member according to PTL 1 has caused the faulty cleaning. As the result, they have assumed the mechanism therefor as stated below.

Figure 2:
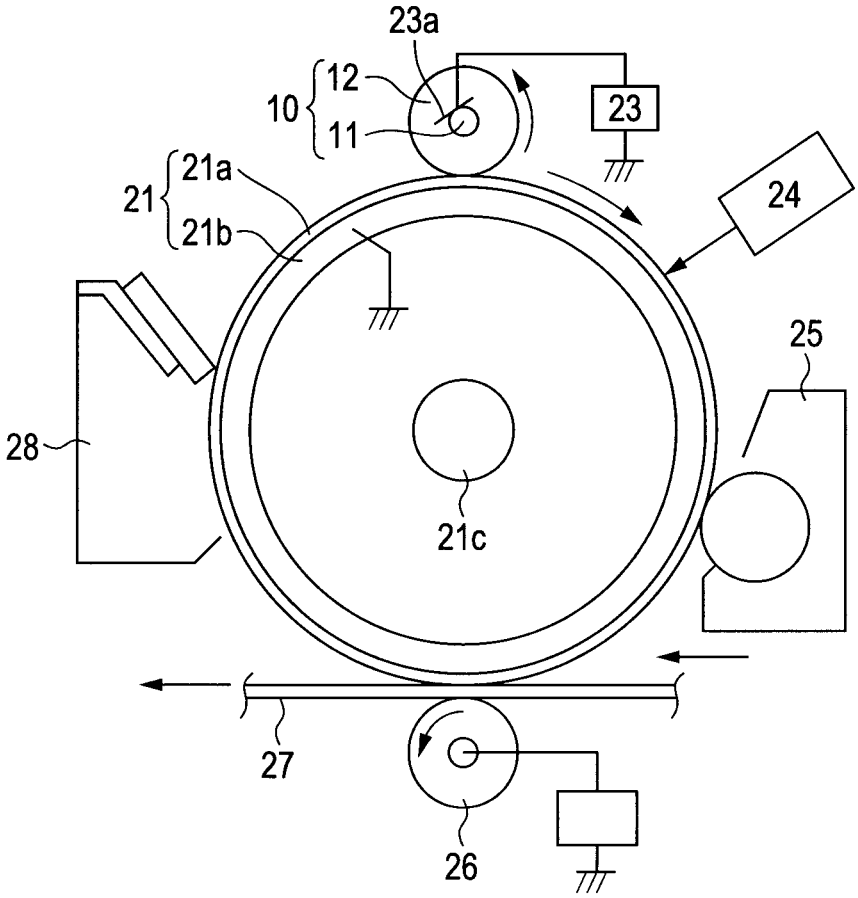
FIG. 2 is a schematic view showing an example of the construction of an electrophotographic apparatus having a charging member.

An example of the construction of an electrophotographic apparatus having the charging member is schematically shown in FIG. 2. An electrophotographic photosensitive member (hereinafter simply "photosensitive member") 21 serving as a charging object member is constituted of a conductive support 21*b* and a photosensitive layer 21*a* formed on the conductive support 21*b*, and has a drum shape. Then, it is rotatingly driven around a shaft 21*c* in the clockwise direction as viewed on the drawing, at a stated peripheral speed.

A charging roller 10 is disposed in contact with the photosensitive member 21 and charges the photosensitive member electrostatically to a stated polarity and potential (primary charging). The charging roller 10 is constituted of a mandrel 11 and an elastic layer 12 formed on around the mandrel 11, and is kept pressed against the photosensitive member 21 under application of pressure at both end portions of the mandrel 11 by means of a press-down means (not shown). It is follow-up rotated as the photosensitive member 21 is rotatingly driven. A stated direct-current (DC) bias is applied to the mandrel 21 through a rubbing-friction electrode 23*a* from a power source 23, whereupon the photosensitive member 21 is electrostatically charged to stated polarity and potential.

The photosensitive member 21 the peripheral surface of which has electrostatically been charged by means of the charging roller 10 is subsequently subjected to exposure (such as laser beam scanning exposure, or slit exposure of images of an original) of intended image information by means of an exposure means 24, whereupon electrostatic latent images corresponding to the intended image information are formed on its peripheral surface.

The electrostatic latent images are then successively developed into visible images as toner images by means of a developing assembly 25. The toner images thus formed are then successively transferred by a transfer means 26 to a transfer material 27 having been transported from a paper feed means section (not shown) to a transfer zone between the photosensitive member 21 and the transfer means 26 at proper timing in the manner synchronized with the rotation of the photosensitive member 21. The transfer means 26 shown in FIG. 2 is a transfer roller, which is charged to a polarity reverse to that of toner from the back of the transfer material 27, whereupon the toner images on the side of the photosensitive member 21 are transferred on to the transfer material 27.

The transfer material 27 to which the toner images have been transferred is separated from the photosensitive member 21 and then transported to a fixing means (not shown), where the toner images are fixed. The transfer material with fixed images is put out as an image-formed matter. Instead, where images are also formed on the back, the transfer material with fixed images is transported to a means for re-transporting it to the transfer zone. The peripheral surface of the photosensitive member 21 from which the toner images have been transferred is cleaned on its surface by removing any toner remaining on the surface of the photosensitive member 21 by means of a cleaning member 28 typified by an elastic blade. It comes that, on the photosensitive member 21 having been cleaned on its surface, a next-cycle electrophotographic image formation process is carried out.

In a course of the above electrophotographic image formation process, the charging roller charges the surface of the photosensitive member electrostatically by making discharge take place at gaps formed near its nip with the photosensitive member 21. On that occasion, any discharge products coming about in the vicinity of the charging roller, any wear dust left on the photosensitive member surface, and so forth adhere to the surface of the photosensitive member. Then, these are pressed against the surface of the photosensitive member at the nip between the charging roller and the photosensitive member, whereby they continue to be accumulated on the surface of the photosensitive member. Then, the coefficient of friction between the photosensitive member and the elastic blade continues to become higher gradually. In due course, the elastic blade begins to vibrate because of a high coefficient of friction between the photosensitive member and the elastic blade, so that the residual toner on the surface of the photosensitive member comes not to be sufficiently removed. As the result, it follows that the next-cycle electrophotographic image formation process is carried out on the photosensitive member to the surface of which the residual toner has adhered.

Here, such an increase in the coefficient of friction between the photosensitive member and the elastic blade has remarkably come in a charging roller having a surface layer formed of an elastic material. The reason therefor is considered to be the following: The charging roller having a surface layer formed of an elastic material has so flexible a surface as to come to have a large area of contact at the nip between the charging roller and the photosensitive member, so that any substances causative of an increase in the coefficient of friction, such as discharge products, may more easily be made to stick to the surface of the photosensitive member.

Accordingly, the present inventors have made various studies at an aim to obtain a charging member that may make any discharge products not easily stick to the surface of the photosensitive member, though having a flexibility for securing an appropriate nip between it and the photosensitive member. As the result, they have discovered that the above objects can be achieved by a charging member having as a surface layer an elastic layer where a region is formed the surface of which has been cured by irradiation with electron rays and also, by this region, at least one type of spherical particles selected from spherical silica particles, spherical alumina particles and spherical zirconia particles are supported in such a state that they are exposed at least in part to the surface, where the surface stands roughened by the spherical particles.

Preferred embodiments of the present invention are described below.

—Charging Member—

The charging member according to the present invention has a conductive support and an elastic layer that is a surface layer. Also, the surface of the elastic layer stand roughened by at least one type of spherical particles selected from spherical silica particles, spherical alumina particles and spherical zirconia particles. Still also, the elastic layer has on its surface a region having been cured by irradiation with electron rays, and, about at least part of particles among the spherical particles, part of each particle is supported by the cured region, in such a state as to be exposed to the surface of the elastic layer.

Figure 1:
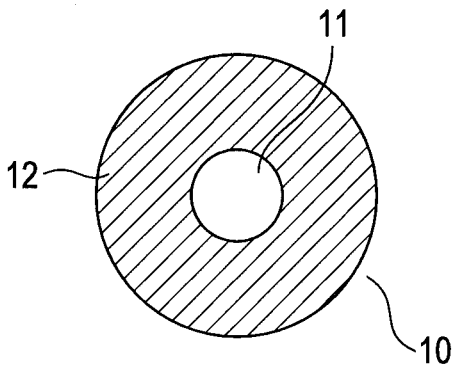
FIG. 1 is a diagrammatic sectional view showing an example of the constitution of a charging roller.
Figure 3A:
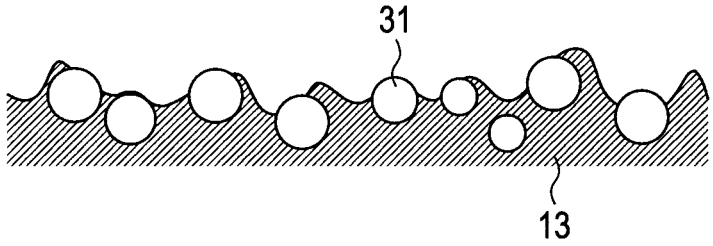
FIG. 3A is a diagrammatic sectional view showing a form of the surface of a charging roller.
Figure 3B:
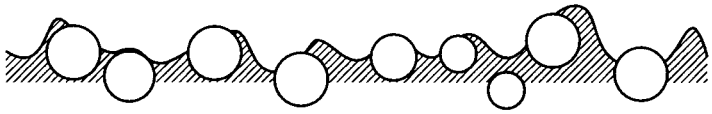
FIG. 3B is a diagrammatic sectional view showing another form of the surface of a charging roller.

An example of the constitution of a charging roller as the charging member of the present invention is schematically shown in FIG. 1. A charging roller 10 is constituted of a mandrel 11 and an elastic layer 12 formed on around the mandrel 11. The charging member according to the present invention may be used as the charging roller 10 of the electrophotographic apparatus shown in FIG. 2. FIGS. 3A and 3B are diagrammatic views showing forms of the surface of the charging roller of the present invention.

The elastic layer of the charging roller according to the present invention contains at least one type of spherical particles 31 selected from spherical silica particles, spherical alumina particles and spherical zirconia particles, and its surface stands roughened by the spherical particles. Also, the surface of the elastic layer has been subjected to cure treatment by irradiation with electron rays, and, about at least part of particles among the above spherical particles, part of each particle is exposed to the surface of the elastic layer and also supported by a region 13 having been cured by the irradiation with electron rays, of the elastic layer.

Since the spherical particles are thus supported by such a cured region 13, the spherical particles have been made not easily buried in the elastic layer at its nip even when the elastic layer comes into contact with the charging object member such as the photosensitive member. As the result, even at the nip, the spherical particles, having a high hardness, can maintain an unevenness profile of the surface in such a state that they are exposed in part to the surface of the elastic layer, and can make small its area of contact with the photosensitive member. Also, since the spherical silica particles, spherical alumina particles and spherical zirconia particles are spherical in shape, the photosensitive member can be kept from being scratched or from wearing in excess on its surface even when the part standing uncovered from the surface of the elastic layer comes into direct contact with the photosensitive member.

In addition, the cure treatment by irradiation with electron rays enables the elastic layer to be cured only at its surface portion, thus the elastic layer can maintain a low hardness (50 or more to less than 80 in MD-1 hardness) at its interior, i.e., its deep layer portion. Hence, any faulty charging caused by faulty contact attendant to a decrease in width of the nip between the charging roller and the charging object member or any faulty images caused by the sticking of a toner or its external additives with time to the surface of the charging roller can be kept from occurring, which may be seen where the whole charging roller is made to have a high hardness, e.g., where the whole charging roller is made to have a hardness of as high as 80 degrees or more as MD-1 hardness.

Conductive Support:

The conductive support may be any one as long as it has conductivity and also can maintain strength required as the charging roller.

Elastic Layer:

The elastic layer contains a base polymer or a cross-linked product thereof and the spherical particles. As the base polymer, a material may be used which can provide the elastic layer with rubber elasticity in the range of actual service temperature. Such a base polymer may include thermoplastic elastomers and thermosetting rubbers.

The thermosetting rubbers are rubber compositions obtained by compounding a raw-material rubber with a cross-linking agent. Here, specific examples of the thermosetting rubbers are given below: Natural rubber (NR), isoprene rubber (IR), butadiene rubber (BR), styrene-butadiene rubber (SBR), butyl rubber (IIR), an ethylene-propylene-diene terpolymer rubber (EPDM), an epichlorohydrin homopolymer (CHC), an epichlorohydrin-ethylene oxide copolymer (CHR), an epichlorohydrin-ethylene oxide-acrylic glycidyl ether terpolymer (CHR-AGE), an acrylonitrile-butadiene copolymer (NBR), a hydrogenated product of acrylonitrile-butadiene copolymer (H-NBR), chloroprene rubber (CR), acrylic rubbers (ACM, ANM) and so forth. Specific examples of the thermoplastic elastomers are also given below: Thermoplastic elastomers such as thermoplastic polyolefin type thermoplastic elastomers, polystyrene type thermoplastic elastomers, polyester type thermoplastic elastomers, polyurethane type thermoplastic elastomers, polyamide type thermoplastic elastomers, and vinyl chloride type thermoplastic elastomers.

The elastic layer used in the present invention is incorporated with at least one type of spherical particles selected from spherical silica particles, spherical alumina particles and spherical zirconia particles. Such spherical particles composed of silica, alumina or zirconia have a high hardness (7 or more in new Mohs hardness), and hence the particles themselves are by no means abraded even in a sanding step making use of a grinding wheel or the like as described later, and can be present on the elastic layer surface while being kept spherical. The spherical particles are particles composed of silica, alumina or zirconia as a chief component, and may contain impurities such as $Na_2O$, $K_2O$, $Fe_2O_3$, MnO, CaO, MgO and $TiO_2$. These impurities in the spherical particles may preferably be in a content of 5% by mass or less.

The spherical particles may preferably have a particle diameter of from 2 μm or more to 80 μm or less. As long as their particle diameter is 2 μm or more, the area of contact with the photosensitive member can be kept from increasing because of the particle diameter that may otherwise be small. Also, as long as their particle diameter is 80 μm or less, the charging roller surface can be kept from being stained with a toner and so forth because of the elastic layer that may otherwise have a large surface roughness depending on the size of the particles. The spherical particles may further preferably have particle diameter in the range of from 5 μm or more to 40 μm or less. By these spherical particles, the surface of the elastic layer stands roughened. As the degree to which the surface is roughened, it is preferable that the charging member surface (the surface of the elastic layer) has a ten-point roughness Rz of from 3 μm or more to 20 μm or less.

Further, as the sphericity of the spherical particles, they may preferably be from 100 or more to 160 or less as the value of shape factor SF1 shown below. Here, the shape factor SF1 is an index represented by equation (1) shown below, and means that, the closer to 100 it is, the closer to spheres the particles are. As long as their shape factor is not more than 160, the photosensitive member can be kept from being scratched or from wearing even where the spherical particles stand exposed to the elastic layer surface and come into direct contact with the photosensitive member.

The particle diameter of the spherical particles is "length-average particle diameter" determined by the following method. First, the spherical particles are observed on a scanning electron microscope (trade name: JEOL LV5910; manufactured by JEOL Ltd.) to perform image photography, and the images photographed are analyzed by using image analysis software (trade name: IMAGE-PRO PLUS; available from Planetron Co.). To make analysis, the number of pixels per unit length is calibrated from micron bars at the time of photography, where, in respect of 50 particles picked up at random from the photograph, their unidirectional particle diameters are measured from the number of pixels on the image to determine arithmetic mean particle diameter, which is taken as the particle diameter of the spherical particles.

The shape factor SF1 of the spherical particles used in the present invention is measured by the following method. Information of images photographed on the scanning electron microscope like the particle diameter is inputted into an image analyzer (trade name: LUZEX 3; manufactured by Nireco Corp.), where, in respect of 50 particles picked up at random, their shape factor is calculated according to the following equation (1).

$$SF-1=\{(MXLNG)^2/AREA\}\times(\pi/4)\times(100) \quad (1)$$

wherein MXLNG represents an absolute maximum length of a particle, and AREA represents a projected area of the particle.

The spherical particles may also preferably have a specific surface area of 10 $m^2/g$ or less as a value found by measurement according to JIS 28830 (2001). Inasmuch as the spherical particles have a specific surface area of 10 $m^2/g$ or less, the effect of reinforcement of elastic layer that is due to the spherical particles can be made small. This enables the elastic layer to be kept from having a high hardness. The spherical particles to be incorporated in the elastic layer may be incorporated as a single type or may be incorporated in the form of a blend of two or more types. In this case, the spherical particles in the elastic layer may preferably be in a content of from 10 parts by mass or more to 100 parts by mass or less in total, based on the total mass of the elastic layer. As long as the spherical particles are in a content of 10 parts by mass or more, the spherical particles can be present on the surface in a sufficient quantity and the area of contact with the photosensitive member can be made especially small. Also, as long as the spherical particles are in a content of 100 parts by mass or less, the elastic layer can be kept from being hard because of the spherical particles that may otherwise be incorporated in a large quantity.

The elastic layer may also be incorporated therein with a conductive agent, a filler, a processing aid, an antioxidant, a cross-linking agent, a cross-linking accelerator, a cross-linking accelerator activator, a cross-linking retarder, a dispersant and/or the like. Specific examples of the conductive agent are given below.

Carbon materials such as carbon black and graphite, oxides such as titanium oxide and tin oxide, and metals such as Cu and Ag, electron-conductive agents such as conductive particles made electrically conductive by coating particle surfaces with oxides or metals, inorganic ionic substances such as lithium perchlorate, sodium perchlorate and calcium perchlorate, cationic surface-active agents such as lauryl trimethylammonium chloride and stearyl trimethylammonium chloride, amphoteric surface-active agents such as lauryl betaine, quaternary ammonium salts such as tetraethylammonium perchlorate, and ion-conductive agents such as an organic-acid lithium salt (lithium trifluoromethane sulfonate).

In the present specification, the elastic layer means the elastic layer as a surface layer (also often "surface elastic layer" unless particularly noted. In the present invention, an adhesive layer may also be formed between the conductive support and the surface elastic layer. The elastic layer may also be made into a multiple layer (may have at least one elastic layer other than the surface elastic layer; provided that, when made into a multiple layer, the layer containing the spherical particles (the surface elastic layer) must be formed on the outermost surface. Also, when the elastic layer is made into a multiple layer, it is preferable for the respective layer to be simultaneously shaped by using a multi-layer extruder in a method of extruding a rubber composition in the shape of a tube or a method of extruding it by using a cross head, as detailed later. In the present invention, in order to most effectively simplify a production process, it is preferable for the elastic layer to be a single layer, i.e., to be only one elastic layer in the charging member according to the present invention. Then, as the thickness of the elastic layer in this case, it may preferably be in the range of from 0.8 mm to 4.0 mm, and particularly from 1.2 mm to 3.0 mm, in order to secure the nip width between the elastic layer and the charging object member.

—Charging Member Production Process—

The charging member production process of the present invention has the following step 1 to step 3.

Step 1: The step of forming on the conductive support a rubber layer containing at least one type of spherical particles selected from spherical silica particles, spherical alumina particles and spherical zirconia particles.

Step 2: The step of sanding the surface of the rubber layer to make, about at least part of particles among the spherical particles, part of each particle exposed to the surface.

Step 3: The step of irradiating with electron rays the surface of the rubber layer having been sanded, further to cure the surface.

The respective steps are described below.

Step 1:

First, a rubber layer containing the spherical particles is formed on the conductive support. Here, the rubber layer is one obtained by extruding in a stated shape a mixture (which may contain the base polymer and additives or the like) containing the spherical particles. A specific example is described below.

A mixture of i) the base polymer constituting the elastic layer and ii) at least one type of spherical particles selected from spherical silica particles, spherical alumina particles and spherical zirconia particles is prepared. Here, where the base polymer is a thermoplastic rubber, the mixture is called a rubber composition. Also, where the base polymer is an unvulcanized thermoplastic rubber, the mixture is called an unvulcanized rubber composition.

Subsequently, the conductive support is covered on its periphery with the rubber composition or unvulcanized rubber composition so as to be shaped into a roller. Herein, the roller obtained by covering the support on its periphery with the rubber composition is simply called a rubber roller. Also, the roller obtained by covering the support on its periphery with the unvulcanized rubber composition is called an unvulcanized rubber roller. As to the unvulcanized rubber roller, it is then subjected to cross-linking processing or the like to effect curing to obtain a vulcanized rubber roller.

As a method for shaping the rubber composition or unvulcanized rubber composition into a roller, it may include the following methods (a) to (c).

(a) A method in which the rubber composition is extruded in the shape of a tube by means of an extruder and the mandrel is inserted thereinto.

(b) A method in which the rubber composition is co-extruded in the shape of a cylinder around the mandrel by means of an extruder fitted with a cross head, to obtain an extruded product having the desired outer diameter.

(c) A method in which, using an injection molding machine, the rubber composition is injected to the interior of a mold that provides the desired outer diameter, to obtain a molded product.

In particular, the method (b) is most preferable because it facilitates continuous manufacture, has a small number of steps and is suited for production at a low cost. The unvulcanized rubber roller is vulcanized by heat treatment. As a specific example of a method for the heat treatment, it may include hot-air oven heating making use of a gear oven, superheating vulcanization making use of far infrared rays, and steam heating making use of a vulcanizing pan. In particular, the hot-air oven heating and the far infrared ray superheating are preferable because they are suited for continuous manufacture.

Step 2:

The surface of the rubber roller or unvulcanized rubber roller obtained through the step (1) is processed by sanding to make, about at least part of particles among the spherical particles, part of each particle exposed to the surface. As the spherical particles, at least one type of spherical silica particles, spherical alumina particles and spherical zirconia particles are used. These particles are commonly hard, and hence the particles themselves can not be easily abraded even in a sanding step making use of a grinding wheel or the like. Thus, even after the sanding, the particles can easily be kept spherical and also can be present on the rubber layer surface.

As an example of a method of sanding the surface of the rubber roller (rubber layer), it may include a traverse grinding system in which a grinding wheel or the roller is moved in the thrust direction of the roller to carry out grinding, and a plunge-cut grinding system in which, while the roller is rotated around its mandrel shaft, the roller is cut with a grinding wheel having a width larger than the former's length, without reciprocating the latter. The plunge-cut grinding system has an advantage that the rubber roller can be sanded at a time in its whole length, and is preferable because the time for working can be made shorter than that in the traverse grinding system.

Step 3:

Finally, the surface of the rubber layer having been sanded (the rubber roller surface) is irradiated with electron rays to subject the surface to cure treatment to form the elastic layer having on its surface a region having been cured.

Figure 5:
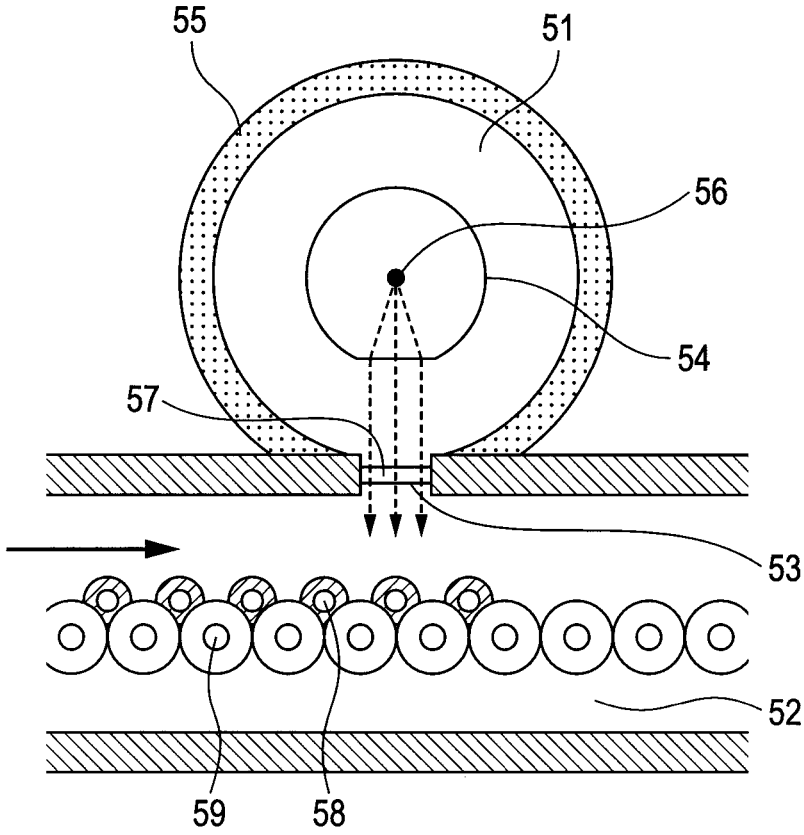
FIG. 5 is a schematic view showing an example of the construction of an electron-ray irradiation equipment.

An electron-ray irradiation equipment is schematically shown in FIG. 5. As an electron-ray irradiation equipment usable in the present invention, an equipment may preferably be used in which the roller surface is irradiated with electron rays while the rubber roller having been sanded is rolled or rotated. For example, as shown in FIG. 5, it is one having an electron-ray generation part 51, an irradiation chamber 52 and an irradiation window 53. The electron-ray generation part 51 has a terminal 54 at which electron rays are produced and an accelerating tube 55 which accelerates in a vacuum space (accelerating space) the electron rays produced at the terminal 54. Also, the interior of the electron-ray generation part is kept at a vacuum of from $10^{-3}$ Pa or more to $10^{-6}$ Pa or less by means of a vacuum pump (not shown) or the like in order to prevent electrons from colliding with gas molecules to lose energy.

A filament 56 is electrified by a power source (not shown) to come heated, whereupon the filament 56 emits thermions, and, among the thermions emitted, only those having passed through the terminal 54 are effectively taken out as electron rays. Then, the electron rays are accelerated in the accelerating space inside the accelerating tube 55 by electron ray accelerating voltage, and thereafter pierce through an irradiation window foil 57, where a rubber roller 58 having been sanded and being transported inside the irradiation window 53 provided beneath the irradiation chamber 52 is irradiated therewith.

When the rubber roller 58 having been sanded is irradiated with electron rays, the interior of the irradiation chamber 52 may be kept under an atmosphere of nitrogen. Also, the rubber roller 58 having been sanded is, being rolled with a roller rolling member 59, moved inside the irradiation chamber 52 by a transport means from the left side to the right side as viewed in FIG. 5. Incidentally, the electron-ray generation part 51 and the irradiation chamber 52 are kept by lead shielding on their peripheries so that any X-rays produced secondarily during the irradiation with electron rays may not leak outside.

The irradiation window foil 57 is made of metal foil, and is a material which separates the vacuum atmosphere inside the electron-ray generation part from the aerial atmosphere inside the irradiation chamber. Through this irradiation window foil 57, the electron rays are taken out into the irradiation chamber 52. As mentioned above, when electron rays are used in irradiating the roller, the interior of the irradiation chamber 52, in which the roller is irradiated with electron rays, may be kept under an atmosphere of nitrogen. Accordingly, the irradiation window foil 57 provided at the boundary between the electron-ray generation part 51 and the irradiation chamber 52 is desired to have no pinholes, have a mechanical strength high enough to well maintain the vacuum atmosphere inside the electron-ray generation part, and readily allow the electron rays to transmit therethrough. Hence, it is desirable for the irradiation window foil 57 to be a metal having a low specific gravity and a small wall thickness, thus, usually, aluminum or titanium foil is used.

Conditions for effective treatment by electron rays depend on accelerating voltage and dose of the electron rays. The accelerating voltage influences cure treatment depth (also called cure treatment thickness or cured-region thickness), and, as conditions for the accelerating voltage used in the present invention, may preferably be in a low-energy range of from 40 kV or more to 300 kV or less. As long as it is 40 kV or more, a cure treatment depth sufficient for obtaining the effect of the present invention can easily be attained. Also, inasmuch as it is 300 kV or less, the electron-ray irradiation equipment can especially be prevented from otherwise coming large in size to involve a high equipment cost. As further preferable conditions for the accelerating voltage, it is from 80 kV or more to 150 kV or less.

The dose of electron rays in the irradiation with electron rays is defined by the following equation (2):

$$D=(K\cdot I)/V \qquad (2).$$

Here, D is the dose (kGy), K is an equipment constant, I is electron current (mA), and V is treatment speed (M/min). The equipment constant K is a constant representing the efficiency of individual equipments, and is an index of the performance of the equipment. The equipment constant K may be determined by measuring doses under conditions of a uniform accelerating voltage but changing the electron current and treatment speed.

To measure the dose of electron rays, a dose measuring film may be stuck to the roller surface, and this is actually treated with the electron-ray irradiation equipment, where the dose measuring film may be measured with a film dosimeter. On that occasion, a dose measuring film of trade name: FWT-60 and a film dosimeter of trade name: FWT-92 D Model (both manufactured by Far West Technology, Inc.) may be used. The electron rays used in the present invention may preferably be in a dose of from 30 kGy or more to 3,000 kGy or less. As long as the dose is 30 kGy or more, a surface hardness sufficient for obtaining the effect of the present invention can easily be attained. Also, inasmuch as it is 3,000 kGy or less, the electron-ray irradiation equipment can especially be prevented from otherwise coming large in size, or involving a high equipment cost because of treatment time otherwise elongated. As further preferable conditions for the dose of electron rays, it is from 200 kGy or more to 2,000 kGy or less.

The spherical particles standing exposed to the elastic layer surface in the present invention are supported by a region having been cured by the irradiation with electron rays. Forms of the surface of the charging roller of the present invention are diagrammatically shown in FIGS. 3A and 3B. FIG. 3A shows a case in which such a cured region has a large thickness and FIG. 3B a case in which the cured region has a small thickness. The thickness of the cured region may be not to be particularly specified, but may preferably be not less than 0.5 time the average particle diameter (length-average particle diameter) of the spherical particles to be used. Inasmuch as the cured region is in a thickness not less than 0.5 time the average particle diameter, the spherical particles standing exposed to the surface can more surely be kept from being buried in the elastic layer at the par of contact with the photosensitive member. The cured region may most preferably be in a thickness of from not less than the same value as the average particle diameter of the spherical particles to 200 μm or less. Inasmuch as the region cured by the irradiation with electron rays is in a thickness of 200 μm or less, the width of the nip between the charging member and the photosensitive member can sufficiently be secured.

As described previously, the cure treatment depth may change depending on the accelerating voltage. It is also commonly known that the transmission depth of electron rays may differ depending on the density of the substance to be irradiated. Accordingly, as a method of ascertaining the thickness of an actual region having been cured by cure treatment, measurement of surface hardness by using a universal hardness meter is available.

Universal hardness is a value of physical properties that is found by making an indentation with an indenter to a measuring object under application of a load, and is found as the value ($N/mm^2$) of (testing load)/(surface area of penetrator under testing load). This universal hardness may be measured with a hardness measuring instrument as exemplified by an ultra-microhardness meter H-100V (trade name), manufactured by Helmut Fischer GmbH.

In this measuring instrument, a pyramid indenter or the like is forced into the measuring object under application of a stated relatively small test load, and, at a point of time where it has come to a stated indentation depth, the area of surface with which the indenter is in contact is determined to find the universal hardness according to the above expression. That is, when the indenter is forced into the measuring object under conditions of constant load measurement, the stress on that occasion with respect to the depth of indentation is defined to be the universal hardness.

Figure 4:
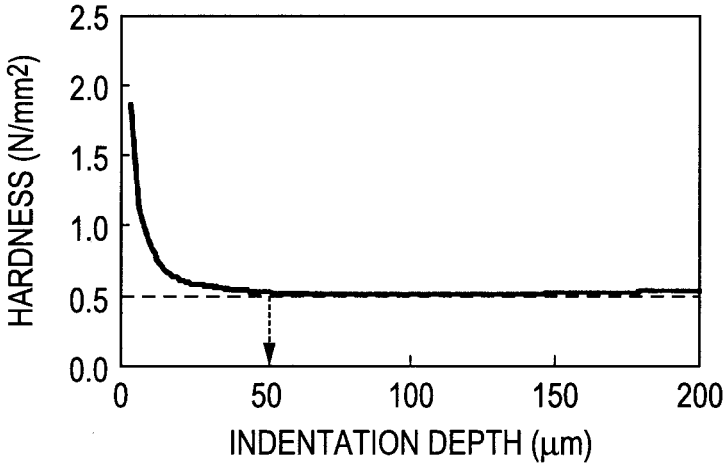
FIG. 4 is a graph showing an example of measurement of universal hardness.

An example of the measurement of universal hardness is shown in FIG. 4. In the graph the indentation depth (μm) is plotted as abscissa and the hardness ($N/mm^2$) as ordinate. As shown in FIG. 4, the value on abscissa at a point where a straight line extrapolated from a measurement region of from 150 μm or more to 200 μm or less on the abscissa, which shows a small change in hardness with respect to the indentation depth and is a straight-line region, comes to deviated from a measurement curve may be defined as the thickness of the cured region. Here, the thickness of the cured region in the measurement example shown in FIG. 4 is 50 μm.

EXAMPLES

The present invention is described below in greater detail by giving Examples, which, however, by no means limit the present invention. In the following, "part(s)" refers to "part(s) by mass" unless particularly noted. As reagents and the like, commercially available high-purity products are used unless particularly specified. In the respective Examples, rubber rollers were produced.

Example 1

Preparation of unvulcanized rubber composition for elastic layer; Materials shown in Table 1 below were mixed by means of a 6-liter pressure kneader (product name; TD6-15MDX, manufactured by Toshin Co., Ltd.) for 16 minutes in a packing of 70 vol. % and at a number of blade revolutions of 30 rpm to obtain a first-stage kneaded rubber composition.

TABLE 1

| | |
|---|---|
| Raw-material rubber NBR (trade name: JSR N230SV; available from JSR Corporation) | 100 parts |
| Zinc stearate | 1 part |

TABLE 1-continued

| | |
|---|---|
| Zinc oxide | 5 parts |
| Calcium carbonate (trade name: NANOX #30; available from Maruo Calcium Co., Ltd.) | 20 parts |
| Carbon black (trade name: TOKA BLACK #7360SB; available from Tokai Carbon Co., Ltd.) | 45 parts |
| Spherical silica particles 1 (trade name: FB-20D; available from Denki Kagaku Kogyo Kabushiki Kaisha) | 40 parts |

Next, materials shown in Table 2 below were mixed by means of an open roll of 12 inches (0.30 m) in roll diameter at a number of front-roll revolutions of 8 rpm and a number of back-roll revolutions of 10 rpm and at a roll gap of 2 mm, carrying out 20 cuts in total. Thereafter, the roll gap was changed to 0.5 mm to carry out tailing 10 times to obtain an unvulcanized rubber composition for elastic layer.

TABLE 2

| | |
|---|---|
| First-stage kneaded rubber composition | 211 parts |
| Sulfur | 1.2 parts |
| Tetrabenzylthiuram disulfide [trade name: PERKACIT-TBzTD (simply "TBzTD"); available from Flexsys Co.] | 4.5 parts |

Formation of vulcanized rubber layer; A columnar conductive mandrel (made of steel and plated with nickel on its surface) of 6 mm in diameter and 244 mm in length was coated with a conductive vulcanization adhesive (trade name; METALOC U-20, available from Toyokagaku Kenkyusho Co., Ltd.) over the column surface on its middle portion of 222 mm in axial direction, followed by drying at 80° C. for 30 minutes.

Next, the above unvulcanized rubber composition was extruded together with the mandrel while being shaped coaxially around the mandrel and in the shape of a cylinder, by means of an extrusion equipment making use of a cross head to produce an unvulcanized rubber roller of 8.8 mm in diameter which was coated with the unvulcanized rubber composition on the outer periphery of the mandrel. On that occasion, as an extruder, an extruder having a cylinder diameter of 45 mm and an L/D of 20 was used, making temperature control to 90° C. for a cylinder and 90° C. for a screw at the time of extrusion.

The unvulcanized rubber composition layer of the unvulcanized rubber roller thus shaped was cut at 3 spots of both end portions in its width direction to make the unvulcanized rubber composition layer be 226 mm in its axial length. Thereafter, this was heated at 160° C. for 40 minutes by means of an electric furnace to vulcanize the unvulcanized rubber composition layer to make it into a vulcanized rubber layer. Subsequently, the vulcanized rubber layer was sanded on its surface by means of a sander of a plunge-cut grinding system to obtain a vulcanized rubber roller having a vulcanized rubber layer with a crown shape of 8.35 mm in end-portion diameter and 8.50 mm in middle-portion diameter and part of the spherical particles of which stood exposed to the surface.

Measurement of hardness of vulcanized rubber roller; The MD-1 hardness of the vulcanized rubber roller standing before the irradiation with electron rays was measured. In the measurement, a microhardness meter (trade name; MD-1 capa, manufactured by Kobunshi Keiki Co., Ltd.) was used to make measurement in a peak-hold mode in an environment of temperature 23° C. and relative humidity 55%. Stated more specifically, the vulcanized rubber roller was placed on a plate made of a metal, and a block made of a metal was placed to simply fasten the vulcanized rubber roller so as not to roll over. Then, a type-A measuring terminal was pressed against the metal plate accurately at the center of the vulcanized rubber roller in the vertical direction, where a value after 5 seconds was read. This was measured at both end portions positioned 30 to 40 mm away from rubber ends of the vulcanized rubber roller in its axial direction and the middle portion thereof, and at 3 spots each in the peripheral direction, i.e., at 9 spots in total. An average value of the measured values obtained was taken as the MD-1 hardness of the vulcanized rubber layer. As the result, the vulcanized rubber layer was found to have an MD-1 hardness of 76°.

Surface Cure Treatment of Vulcanized Rubber Layer Having been Sanded:

The surface of the vulcanized rubber roller having been sanded (the vulcanized rubber layer surface) was irradiated with electron rays to carry out cure treatment to obtain a charging roller having a cured region on the surface of its elastic layer. In the irradiation with electron rays, an electron-ray irradiation equipment (manufactured by Iwasaki Electric Co., Ltd.) of 150 kV in maximum accelerating voltage and 40 mA in maximum electron current was used, and nitrogen gas purging was carried out at the time of the irradiation with electron rays. Treatment conditions were accelerating voltage: 150 kV, electron current: 35 mA, treatment rate: 1 m/min, and oxygen concentration: 100 ppm. Here, the equipment constant at the accelerating voltage of 150 kV of the electron-ray irradiation equipment was 37.8, and the dose calculated according to the equation (2) was 1,323 kGy.

Measurement of Thickness of Cured Region:

The surface hardness of the charging roller was measured with a universal hardness meter to thereby measure its cure treatment thickness. An ultra-microhardness meter (trade name: H-100V; manufactured by Helmut Fischer GmbH) was used in the measurement. A pyramid diamond indenter was also used as an indenter. Indentation rate was conditioned to be the following equation (3):

$$dF/dt = 1{,}000 \text{ mN}/240 \text{ s} \quad (3).$$

In the equation (3), F represents force, and t represents time.

As shown in FIG. 4, the value on abscissa at a point where a straight line extrapolated from a measurement region of from 150 μm or more to 200 μm or less on the abscissa, which showed a small change in hardness with respect to the indentation depth, came to deviated from a measurement curve was found as the thickness of the cured region. As the result, the thickness of the cured region was 90 μm.

Measurement of Surface Roughness:

Ten-point average surface roughness Rz of the charging roller (elastic layer) was measured. It was measured according to JIS B0601:1982, using a surface roughness meter (trade name: SURFCORDER SE-3400; manufactured by Kosaka Laboratory, Ltd.). In the measurement, a contact stylus made of diamond was used which had a tip radius of 2 μm. Measurement speed was set to be 0.5 mm/s; cut-off frequency λc, 0.8 mm; standard length, 0.8 mm; and evaluation length, 8.0 mm. To measure the surface roughness, the values of Rz were calculated from roughness curves obtained respectively on 3 spots in the axial direction×2 spots in the peripheral direction, i.e., 6 spots in total, per each charging roller. Then, the average value of Rz at these 6 spots was found, and this was taken as the value of Rz of the charging roller. As the result, the Rz was found to be 8.9 μm.

Image Evaluation:

A laser beam printer (trade name: LASER JET P1005; manufactured by Hewlett-Packard Co.; for A4-paper lengthwise printing) was readied as an electrophotographic apparatus used in the evaluation. The charging roller produced as above was set in a process cartridge for the laser beam printer, and this process cartridge was mounted to the laser beam printer. In an environment of temperature 23° C. and relative humidity 50%, solid images and halftone images (images in which lines each being 1 dot in width and 2 dots in space were drawn in the rotational direction and vertical direction of an electrophotographic photosensitive member) were separately outputted on one sheet each. These are called initial-stage solid images and initial-stage halftone images, respectively.

Next, after such electrophotographic images were outputted on one sheet, a running test was conducted in which an intermittent motion of image formation such that the rotation of the electrophotographic photosensitive member was completely stopped and then a motion of image formation was again started was repeated to output the electrophotographic images on 1,000 sheets. The images outputted here were images in the shape of ruled lines in which a 118-dot space was repeated after every 2-dot horizontal line.

Thereafter, the solid images and the halftone images were separately outputted on one sheet each. These are called after-running-test solid images and after-running-test halftone images, respectively.

Then, about two sheets of paper of the solid images and two sheets of paper of the halftone images thus obtained, whether or not any density non-uniformity caused by non-uniform charging was seen and how much it was were visually observed to make evaluation according to the following criteria.

Evaluation (1): Evaluation of Charging Performance (Initial Stage and after Running)

The initial-stage solid images and the initial-stage halftone images were visually observed on whether or not any density non-uniformity caused by non-uniform charging was seen, to make evaluation according to the following criteria. The after-running-test solid images and the after-running-test halftone images were also likewise observed to make evaluation alike. This can tell charging performance at the initial-stage and after the running test of the charging roller according to this Example.

A: Any density non-uniformity caused by non-uniform charging is not seen in both the solid images and the halftone images.

B: Slight density non-uniformity caused by non-uniform charging is not seen only in the halftone images.

C: Density non-uniformity is seen in the halftone images, and also slight density non-uniformity caused by non-uniform charging is not seen in the solid images.

D: Density non-uniformity caused by non-uniform charging is not seen in both the solid images and the halftone images.

Evaluation (2): Evaluation on any Image Defects Caused by Faulty Cleaning:

The images on 1,000 sheets which were outputted in the above running test were visually observed on whether or not any image defects caused by faulty cleaning of the photosensitive member were seen and how much they were, to make evaluation according to the following criteria.

A: Any only one sheet of print is not seen on which the image defects caused by faulty cleaning have occurred.

B: The number of print on which any slight image defects caused by faulty cleaning have occurred is one sheet or more to less than 100 sheets.

C: The number of print on which any clear image defects caused by faulty cleaning have occurred is one sheet or more to less than 100 sheets.

D: The number of print on which any clear image defects caused by faulty cleaning have occurred is 100 sheets or more.

Evaluation (3): Evaluation of Coefficient of Friction Between Photosensitive Member and Elastic Blade:

An elastic blade was brought into contact in the counter direction with the surface of the photosensitive member of the laser beam printer used in the above image formation, in the state of which the coefficient of friction between the photosensitive member and the elastic blade was measured. This measurement can tell whether or not any sticking of toner and so forth which was caused by the charging roller was seen or how much it was.

As a method for measurement, first, in the laser beam printer, a unit portion where the photosensitive member and the elastic blade were set in was taken out of its process cartridge. Then, a motor to which a torque meter (trade name: TP-10KCE; manufactured by Kyowa Electronic Instruments Co., Ltd.) was connected was connected to a drive unit of the photosensitive member, and the torque acting when the photosensitive member was rotated with the motor at a number of revolutions of 85 rpm was measured with the torque meter, where an average value of measured values corresponding to one round of the forth rotation from the start of rotation of the photosensitive member was taken as the value of torque in this Example.

The results of the above Evaluations 1 to 3 are shown in Table 4.

Example 2

A vulcanized rubber roller was produced in the same way as that of Example 1 except that, in making up the first-stage kneaded rubber composition of Example 1, the spherical silica particles 1 was changed for the like parts by mass of spherical silica particles 2 (trade name: FB-20D; available from Denki Kagaku Kogyo Kabushiki Kaisha) as shown in Table 4. The hardness of its vulcanized rubber layer was measured in the same way as that in Example 1 to find that it was 75°. The surface of the vulcanized rubber roller having been sanded was subjected to cure treatment by irradiation with electron rays in the same way as that in Example 1 to produce a charging roller.

Example 3

An unvulcanized rubber composition for elastic layer was prepared in the same way as that of Example 1 except that the spherical silica particles 1 used in the first-stage kneaded rubber composition of Example 1 was changed for the like parts by mass of spherical silica particles 3 (trade name: HS-301; available from Micron Inc.), to produce a vulcanized rubber roller having been sanded. The hardness of the vulcanized rubber layer of the vulcanized rubber roller having been sanded was measured in the same way as that in Example 1 to find that it was 77°. The surface of the vulcanized rubber roller having been sanded was subjected to cure treatment by irradiation with electron rays in the same way as that in Example 1 to produce a charging roller.

Example 4

An unvulcanized rubber composition for elastic layer was prepared in the same way as that of Example 1 except that the spherical silica particles 1 used in the first-stage kneaded rubber composition of Example 1 was changed for the like parts by mass of spherical silica particles 4 (trade name: HS-305; available from Micron Inc.) to produce a vulcanized rubber roller having been sanded. The hardness of the vulcanized rubber layer of the vulcanized rubber roller having been sanded was measured in the same way as that in Example 1 to find that it was 74°. The surface of the vulcanized rubber roller having been sanded was subjected to cure treatment by irradiation with electron rays in the same way as that in Example 1 to produce a charging roller.

Example 5

A charging roller was produced in all the same way as that of Example 4 except that the conditions for irradiation with electron rays in Example 4 were changed to accelerating voltage: 80 kV, electron current: 35 mA, treatment rate: 1 m/min, and oxygen concentration: 100 ppm. Here, the equipment constant at the accelerating voltage of 80 kV of the electron-ray irradiation equipment was 20.4, and the dose calculated according to the equation (2) was 714 kGy. The measurement of cure treatment thickness of the charging roller, the measurement of its surface roughness and the image evaluation were made in the same way as those in Example 1.

Example 6

The spherical silica particles 2 in the first-stage kneaded rubber composition of Example 2 was incorporated in an amount changed to 10 parts by mass, and the first-stage kneaded rubber composition in the unvulcanized rubber composition was made in an amount changed to 181 parts by mass. An unvulcanized rubber composition for elastic layer was prepared in all the same way as that of Example 2 except for these to produce a vulcanized rubber roller having been sanded. The hardness of the vulcanized rubber layer of the vulcanized rubber roller having been sanded was measured in the same way as that in Example 1 to find that it was 72°. The surface of the vulcanized rubber roller having been sanded was subjected to cure treatment by irradiation with electron rays in the same way as that in Example 1 to produce a charging roller.

Example 7

The spherical silica particles 1 used in the first-stage kneaded rubber composition of Example 1 was changed for 50 parts by mass of spherical alumina particles 1 (trade name: AY-118; available from Micron Inc.), and the first-stage kneaded rubber composition in the unvulcanized rubber composition was made in an amount changed to 221 parts by mass. An unvulcanized rubber composition for elastic layer was prepared in all the same way as that of Example 1 except for these to produce a vulcanized rubber roller having been sanded. The hardness of the vulcanized rubber layer of the vulcanized rubber roller having been sanded was measured in the same way as that in Example 1 to find that it was 75°. The surface of the vulcanized rubber roller having been sanded was subjected to cure treatment by irradiation with electron rays in the same way as that in Example 1 to produce a charging roller.

Example 8

The raw-material rubber NBR used in the first-stage kneaded rubber composition of Example 7 was changed for the like parts by mass of SBR (trade name: TOUGHDEN; available from Asahi Kasei Chemicals Corporation), and the carbon black was mixed in an amount changed to 47 parts by mass. Also, the first-stage kneaded rubber composition in the unvulcanized rubber composition was made in an amount changed to 223 parts by mass, and the vulcanization accelerator tetrabenzylthiuram disulfide was used in an amount changed to 1.0 part by mass. Further, 1.0 part by mass of N-t-butyl-2-benzothiazol sulfenamide (trade name: SANTOCURE-TBSI (simply "TBSI"); available from Flexsys Co.). An unvulcanized rubber composition for elastic layer was prepared in all the same way as that of Example 7 except for these to produce a vulcanized rubber roller having been sanded. The hardness of the vulcanized rubber layer of the vulcanized rubber roller having been sanded was measured in the same way as that in Example 1 to find that it was 77°. A charging roller was then produced in all the same way as that of Example 1 except that the accelerating voltage of the conditions for irradiation with electron rays in Example 1 was changed to 125 kV. On that occasion, the equipment constant at the accelerating voltage of 125 kV of the electron-ray irradiation equipment was 36.2, and the dose calculated according to the equation (2) was 1,267 kGy.

Example 9

The spherical silica particles 1 used in the first-stage kneaded rubber composition of Example 1 was changed for 60 parts by mass of spherical alumina particles 2 (trade name: AX3-32; available from Micron Inc.). The first-stage kneaded rubber composition in the unvulcanized rubber composition was also made in an amount changed to 231 parts by mass. An unvulcanized rubber composition was prepared in all the same way as that of Example 1 except for these to produce a vulcanized rubber roller having been sanded. The hardness of the vulcanized rubber layer of the vulcanized rubber roller having been sanded was measured in the same way as that in Example 1 to find that it was 78°. The surface of the vulcanized rubber roller having been sanded was subjected to cure treatment by irradiation with electron rays in the same way as that in Example 1 to produce a charging roller.

Example 10

The spherical silica particles 1 used in the first-stage kneaded rubber composition of Example 1 was changed for 50 parts by mass of spherical zirconia particles 1 (trade name: NZ Beads; available from Niimi Sangyo Co., Ltd.). The first-stage kneaded rubber composition in the unvulcanized rubber composition was also made in an amount changed to 221 parts by mass. An unvulcanized rubber composition was prepared in all the same way as that of Example 1 except for these to produce a vulcanized rubber roller having been sanded. The hardness of the vulcanized rubber layer of the vulcanized rubber roller having been sanded was measured in the same way as that in Example 1 to find that it was 73°. The surface of the vulcanized rubber roller having been sanded was subjected to cure treatment by irradiation with electron rays in the same way as that in Example 1 to produce a charging roller.

Example 11

The spherical zirconia particles 1 in the first-stage kneaded rubber composition of Example 10 was incorporated in an amount changed to 100 parts by mass, and the first-stage kneaded rubber composition in the unvulcanized rubber composition was made in an amount changed to 271 parts by mass. An unvulcanized rubber composition for elastic layer was prepared in all the same way as that of Example 10 except for these to produce a vulcanized rubber roller having been sanded. The hardness of the vulcanized rubber layer of the vulcanized rubber roller having been sanded was measured in the same way as that in Example 1 to find that it was 76°. The surface of the vulcanized rubber roller having been sanded was subjected to cure treatment by irradiation with electron rays in the same way as that in Example 5 to produce a charging roller.

Example 12

The spherical silica particles 1 in the first-stage kneaded rubber composition of Example 1 was incorporated in an amount changed to 20 parts by mass, and 20 parts by mass of spherical silica particles 2 was further added. An unvulcanized rubber composition for elastic layer was prepared in all the same way as that of Example 1 except for these to produce a vulcanized rubber roller having been sanded. The hardness of the vulcanized rubber layer of the vulcanized rubber roller having been sanded was measured in the same way as that in Example 1 to find that it was 75°. The surface of the vulcanized rubber roller having been sanded was subjected to cure treatment by irradiation with electron rays in the same way as that in Example 1 to produce a charging roller.

Comparative Example 1

An unvulcanized rubber composition for elastic layer was prepared in the same way as that of Example 1 except that the spherical silica particles were not added to the first-stage kneaded rubber composition of Example 1 and the first-stage kneaded rubber composition in the unvulcanized rubber composition was made in an amount changed to 171 parts by mass, to produce a vulcanized rubber roller having been sanded. The hardness of the vulcanized rubber layer of the vulcanized rubber roller having been sanded was measured in the same way as that in Example 1 to find that it was 70°. The surface of the vulcanized rubber roller having been sanded was subjected to cure treatment by irradiation with electron rays in the same way as that in Example 1 to produce a charging roller.

Comparative Example 2

The spherical silica particles 1 used in the first-stage kneaded rubber composition of Example 1 was changed for 20 parts by mass of amorphous silica particles (trade name: BY-001; available from Tosoh Silica Corporation), and the first-stage kneaded rubber composition in the unvulcanized rubber composition was made in an amount changed to 191 parts by mass. An unvulcanized rubber composition for elastic layer was prepared in the same way as that of Example 1 except for these to produce a vulcanized rubber roller having been sanded. The hardness of the vulcanized rubber layer of the vulcanized rubber roller having been sanded was measured in the same way as that in Example 1 to find that it was 88°. The surface of the vulcanized rubber roller having been sanded was subjected to cure treatment by irradiation with electron rays in the same way as that in Example 1 to produce a charging roller.

Comparative Example 3

The spherical silica particles 1 used in the first-stage kneaded rubber composition of Example 1 was changed for the like parts by mass of spherical PMMA (polymethyl methacrylate) particles (trade name: TECHNOPOLYMER; available from Sekisui Chemical Co., Ltd.). An unvulcanized rubber composition for elastic layer was prepared in the same way as that of Example 1 except for this to produce a vulcanized rubber roller having been sanded. The hardness of the vulcanized rubber layer of the vulcanized rubber roller having been sanded was measured in the same way as that in Example 1 to find that it was 83°. The surface of the vulcanized rubber roller having been sanded was subjected to cure treatment by irradiation with electron rays in the same way as that in Example 1 to produce a charging roller.

Comparative Example 4

A charging roller was produced in the same way as that of Example 10 except that, in Example 10, the surface of the vulcanized rubber roller having been sanded was not irradiated with electron rays. The measurement of its surface roughness and the image evaluation were made alike.

The spherical particles and other particles used in the above Examples and Comparative Examples are shown in Table 3. Composition and evaluation results of the rollers according to Examples are shown in Tables 4 and 5. Composition and evaluation results of the rollers according to Comparative Examples are also shown in Table 6.

TABLE 3

| | Material | Shape | Average particle diam. (μm) | Specific surface area ($m^2/g$) | SF1 |
|---|---|---|---|---|---|
| Spherical silica particles 1 | Silica | Spherical | 23 | 3 | 115 |
| Spherical silica particles 2 | Silica | Spherical | 40 | 0.8 | 124 |
| Spherical silica particles 3 | Silica | Spherical | 2.4 | 8 | 112 |
| Spherical silica particles 4 | Silica | Spherical | 80 | 0.4 | 128 |
| Spherical alumina particles 1 | Alumina | Spherical | 17 | 0.14 | 108 |
| Spherical alumina particles 2 | Alumina | Spherical | 5 | 0.6 | 106 |
| Spherical zirconia particles 1 | Zirconia | Spherical | 23 | 0.06 | 113 |
| Amorphous silica particles | Silica | Amorphous | 13.3 | 489 | 168 |
| Spherical PMMA particles | PMMA | Spherical | 12 | — | 105 |

TABLE 4

| | Example: | | | | | | | |
|---|---|---|---|---|---|---|---|---|
| | 1 | 2 | 3 | 4 | 5 | 6 | 7 | 8 |
| NBR | 100 | 100 | 100 | 100 | 100 | 100 | 100 | — |
| SBR | — | — | — | — | — | — | — | 100 |
| Zinc stearate | 1 | 1 | 1 | 1 | 1 | 1 | 1 | 1 |
| Zinc oxide | 5 | 5 | 5 | 5 | 5 | 5 | 5 | 5 |
| Calcium carbonate | 20 | 20 | 20 | 20 | 20 | 20 | 20 | 20 |
| Carbon black | 45 | 45 | 45 | 45 | 45 | 45 | 45 | 47 |
| Spherical silica particles 1 | 40 | — | — | — | — | — | — | — |
| Spherical silica particles 2 | — | 40 | — | — | — | 10 | — | — |
| Spherical silica particles 3 | — | — | 40 | — | — | — | — | — |
| Spherical silica particles 4 | — | — | — | 40 | 40 | — | — | — |
| Spherical alumina particles 1 | — | — | — | — | — | — | 50 | 50 |
| Spherical alumina particles 2 | — | — | — | — | — | — | — | — |
| Spherical zirconia particles 1 | — | — | — | — | — | — | — | — |
| Amorphous silica particles | — | — | — | — | — | — | — | — |
| Spherical PMMA particles | — | — | — | — | — | — | — | — |
| First-stage kneaded rubber content | 211 | 211 | 211 | 211 | 211 | 181 | 221 | 223 |
| Sulfur | 1.2 | 1.2 | 1.2 | 1.2 | 1.2 | 1.2 | 1.2 | 1.2 |
| Vulcanization accelerator TBzTD | 4.5 | 4.5 | 4.5 | 4.5 | 4.5 | 4.5 | 4.5 | 1 |
| Vulcanization accelerator TBSI | — | — | — | — | — | — | — | 1 |
| Elastic layer MD-1 hardness | 76 | 75 | 77 | 74 | 74 | 72 | 75 | 77 |
| Electron rays irradiation conditions | | | | | | | | |
| Accelerating voltage (kV) | 150 | 150 | 150 | 150 | 80 | 150 | 150 | 125 |
| Dose (kGy) | 1,323 | 1,323 | 1,323 | 1,323 | 714 | 1,323 | 1,323 | 1,267 |
| Electric Current (mA) | 35 | 35 | 35 | 35 | 35 | 35 | 35 | 35 |
| Surface roughness Rz (μm) | 8.9 | 11.4 | 3.5 | 13.3 | 13 | 6.9 | 7.5 | 7.3 |
| Cured-region thickness (μm) | 90 | 90 | 90 | 90 | 40 | 90 | 90 | 70 |
| Evaluation items | | | | | | | | |
| (1); initial stage | A | A | A | A | A | A | A | A |
| (1); after running | A | A | A | B | B | A | A | A |
| (2) | A | A | B | A | B | B | A | A |
| (3); torque value (N · m) | 0.147 | 0.135 | 0.159 | 0.127 | 0.155 | 0.167 | 0.145 | 0.137 |

TABLE 5

| Example: | 9 | 10 | 11 | 12 |
|---|---|---|---|---|
| NBR | 100 | 100 | 100 | 100 |
| SBR | — | — | — | — |
| Zinc stearate | 1 | 1 | 1 | 1 |
| Zinc oxide | 5 | 5 | 5 | 5 |
| Calcium carbonate | 20 | 20 | 20 | 20 |
| Carbon black | 45 | 45 | 45 | 45 |
| Spherical silica particles 1 | — | — | — | 20 |
| Spherical silica particles 2 | — | — | — | 20 |
| Spherical silica particles 3 | — | — | — | — |
| Spherical silica particles 4 | — | — | — | — |
| Spherical alumina particles 1 | — | — | — | — |
| Spherical alumina particles 2 | 60 | — | — | — |
| Spherical zirconia particles 1 | — | 50 | 100 | — |
| Amorphous silica particles | — | — | — | — |
| Spherical PMMA particles | — | — | — | — |
| First-stage kneaded rubber content | 231 | 221 | 271 | 211 |
| Sulfur | 1.2 | 1.2 | 1.2 | 1.2 |
| Vulcanization accelerator TBzTD | 4.5 | 4.5 | 4.5 | 4.5 |
| Vulcanization accelerator TBSI | — | — | — | — |
| Elastic layer MD-1 hardness | 78 | 73 | 76 | 75 |
| Electron rays irradiation conditions | | | | |
| Accelerating voltage (kV) | 150 | 150 | 80 | 150 |
| Dose (kGy) | 1,323 | 1,323 | 714 | 1,323 |
| Electric Current (mA) | 35 | 35 | 35 | 35 |
| Surface roughness Rz (μm) | 5.6 | 7.2 | 9.3 | 10.1 |
| Cured-region thickness (μm) | 90 | 90 | 40 | 90 |
| Evaluation items | | | | |
| (1); initial stage | A | A | A | A |
| (1); after running | B | A | A | A |
| (2) | B | B | A | A |
| (3); torque value (N · m) | 0.156 | 0.154 | 0.138 | 0.139 |

TABLE 6

| Comparative Example: | 1 | 2 | 3 | 4 |
|---|---|---|---|---|
| NBR | 100 | 100 | 100 | 100 |
| SBR | — | — | — | — |
| Zinc stearate | 1 | 1 | 1 | 1 |
| Zinc oxide | 5 | 5 | 5 | 5 |
| Calcium carbonate | 20 | 20 | 20 | 20 |
| Carbon black | 45 | 45 | 45 | 45 |
| Spherical silica particles 1 | — | — | — | — |
| Spherical silica particles 2 | — | — | — | — |
| Spherical silica particles 3 | — | — | — | — |
| Spherical silica particles 4 | — | — | — | — |
| Spherical alumina particles 1 | — | — | — | — |
| Spherical alumina particles 2 | — | — | — | — |
| Spherical zirconia particles 1 | — | — | — | 50 |
| Amorphous silica particles | — | 20 | — | — |
| Spherical PMMA particles | — | — | 40 | — |
| First-stage kneaded rubber content | 171 | 191 | 211 | 221 |
| Sulfur | 1.2 | 1.2 | 1.2 | 1.2 |
| Vulcanization accelerator TBzTD | 4.5 | 4.5 | 4.5 | 4.5 |
| Vulcanization accelerator TBSI | — | — | — | — |
| Elastic layer MD-1 hardness | 70 | 88 | 83 | 73 |
| Electron rays irradiation conditions | | | | |
| Accelerating voltage (kV) | 150 | 150 | 150 | Un- |
| Dose (kGy) | 1,323 | 1,323 | 1,323 | irra- |
| Electric Current (mA) | 35 | 35 | 35 | diated |
| Surface roughness Rz (μm) | 2.9 | 4.9 | 6.5 | 7 |
| Cured-region thickness (μm) | 90 | 90 | 90 | — |
| Evaluation items | | | | |
| (1); initial stage | A | A | A | A |
| (1); after running | A | D | C | D |
| (2) | D | C | C | C |
| (3); torque value (N · m) | 0.198 | 0.185 | 0.183 | 0.181 |

As is clear from Table 6, in Comparative Example 1, any spherical particles are not used, and faulty cleaning has occurred because any spherical particles are not present on the surface of the charging roller (elastic layer), thus the image evaluation is ranked as "D".

In Comparative Example 2, amorphous silica particles are incorporated, so that faulty cleaning has occurred because the photosensitive member surface has abraded to come to have a large roughness; being ranked as "C". Also, the elastic layer has an especially high hardness because the amorphous silica particles have a large specific surface area, so that faulty image has also occurred during running because of charging roller staining; being ranked as "D".

In Comparative Example 3, the spherical particles are PMMA particles, and hence the particles themselves have also abraded when the roller surface is sanded, to cause faulty cleaning; being ranked as "C".

In Comparative Example 4, the roller surface is not irradiated with electron rays, and hence faulty cleaning has occurred; being ranked as "C". Faulty image has also occurred during running because of charging roller staining; being ranked as "D".

In contrast thereto, in Examples 1 to 12, as shown in Tables 4 and 5, the image evaluation concerning faulty cleaning and the charging performance after running as well are ranked as "B" or higher, where good images free of any problem in practical use have been obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2010-158734, filed on Jul. 13, 2010, which is herein incorporated by reference as part of this application.

What is claimed is:

1. A charging member comprising a conductive support and an elastic layer as a surface layer;

wherein said elastic layer has a cured region only at the surface portion of the elastic layer, said region having been cured by irradiation with electron rays, spherical particles are supported in said cured region in such a manner that the spherical particles are exposed from the surface of the elastic layer so as to make the surface of said charging member roughened; and wherein said spherical particles are at least one type of spherical particles selected from the group consisting of spherical silica particles, spherical alumina particles and spherical zirconia particles.

2. The charging member according to claim 1, wherein said spherical particles have a length-average particle diameter of from 2 μm or more to 80 μm or less.

3. The charging member according to claim 2, wherein said elastic layer is a single layer and is sole elastic layer; and said elastic layer has a thickness of from 0.8 mm or more to 4.0 mm or less.

4. The charging member according to claim 2, wherein said cured region in said elastic layer has a thickness of not less than 0.5 time the length-average particle diameter of the spherical particles.

5. The charging member according to claim 2, wherein the thickness of said cured region in said elastic layer is from not less than the length-average particle diameter of the spherical particles to 200 μm or less.

6. A process for producing the charging member according to claim 1; the process comprising the steps of:

(1) forming on the support a rubber layer containing the spherical particles;

(2) sanding the surface of the rubber layer to make part of the spherical particles exposed to the surface; and (3) irradiating with electron rays the surface of the rubber layer to which surface the part of the spherical particles stand exposed, obtained by the step (2), to cure the surface to form the elastic layer.

7. An electrophotographic apparatus comprising:

the charging member according to claim 1; and a charging object member that is disposed in contact with the charging member and is chargeable electrostatically by the charging member.

8. A charging member comprising a conductive support and an elastic layer as a surface layer;

wherein said elastic layer has a cured region on the surface thereof, said region having been cured by irradiation with electron rays, spherical particles are supported in said cured region in such a manner that the spherical particles are exposed from the surface of the elastic layer so as to make the surface of said charging member roughened, said spherical particles are at least one type of spherical particles selected from the group consisting of spherical silica particles, spherical alumina particles and spherical zirconia particles, and said elastic layer is a single layer and is sole elastic layer, and said elastic layer has a thickness of from 0.8 mm or more to 4.0 mm or less.

* * * * *